US010427211B2

(12) United States Patent
Zhang et al.

(10) Patent No.: US 10,427,211 B2
(45) Date of Patent: Oct. 1, 2019

(54) FORMING METHOD OF FORGING OF 718 PLUS ALLOY

(71) Applicant: Guizhou Aviation Technical Development Co. Ltd, Guiyang (CN)

(72) Inventors: Hua Zhang, Guiyang (CN); Yongan Wu, Guiyang (CN); Huadong Wang, Guiyang (CN); Zhuangye Xie, Guiyang (CN); Jiadian Yang, Guiyang (CN); Chuanhua Sun, Guiyang (CN); Zhaohui Liu, Guiyang (CN)

( * ) Notice: Subject to any disclaimer, the term of this patent is extended or adjusted under 35 U.S.C. 154(b) by 477 days.

(21) Appl. No.: 15/230,375

(22) Filed: Aug. 6, 2016

(65) Prior Publication Data

US 2017/0173659 A1 Jun. 22, 2017

(30) Foreign Application Priority Data

Dec. 18, 2015 (CN) ..... 2015 1 0952820

(51) Int. Cl.
*B21J 5/02* (2006.01)
*C22C 19/05* (2006.01)
(Continued)

(52) U.S. Cl.
CPC ..... *B21J 5/02* (2013.01); *B21J 1/003* (2013.01); *B21J 1/06* (2013.01); *B21K 1/761* (2013.01); *C22C 19/055* (2013.01); *C22C 19/056* (2013.01)

(58) Field of Classification Search
CPC ..... B21J 1/003; B21J 1/06; B21J 5/008; B21J 5/02; B21J 5/022; B21J 5/08; B21J 5/10; B21J 1/00; B21J 3/00; B21K 1/761
See application file for complete search history.

(56) References Cited

U.S. PATENT DOCUMENTS 2,058,007 A * 10/1936 Edelmeier ..... B21K 1/761 72/111
2,389,758 A * 11/1945 Bittermann ..... B21D 53/16 72/325

(Continued)

FOREIGN PATENT DOCUMENTS

GB 1202080 A * 8/1970 ..... B21J 5/08

OTHER PUBLICATIONS

"Properties and Microstructure of 718Plus Alloy", Bergstrom et al., Jan. 2005.*

*Primary Examiner* — Edward T Tolan
(74) *Attorney, Agent, or Firm* — W&K IP

(57) ABSTRACT

The invention relates to a forming method of an annular forging of 718 Plus alloy, which comprises the following steps: wrapping the cylindrical surface of a blank of the 718 Plus alloy with a first blanket, further heating to 1000-1100° C., then stopping heating, and immediately performing upsetting and punching treatment on the blank; further respectively wrapping the outer surface and the punched inner surface of the blank after treatment with second blankets, further heating to 1000-1060° C., then stopping heating, immediately performing blank holder reaming treatment on the blank; and respectively wrapping the outer surface and the reamed inner surface of the blank after treatment with the second blankets, further heating to 985-1038° C., then stopping heating, and immediately rolling the blank to obtain a final product, after the method is used for treatment, the grain size of the forging achieves level 6 or above, and the surface has no common cracks.

8 Claims, 2 Drawing Sheets

(51) Int. Cl.

| | |
|---|---|
| ***B21J 1/00*** | (2006.01) |
| ***B21J 1/06*** | (2006.01) |
| ***B21K 1/76*** | (2006.01) |

(56) References Cited

U.S. PATENT DOCUMENTS 2,706,850 A * 4/1955 Lambert ..... B21C 23/32 29/423
3,021,594 A * 2/1962 Segal ..... C10M 7/00 29/424
3,181,324 A * 5/1965 Labino ..... B21C 23/32 29/423
3,690,135 A * 9/1972 Gagin ..... B21C 23/32 29/DIG. 47
3,840,461 A * 10/1974 Espunes ..... C10M 125/28 508/136
3,863,325 A * 2/1975 Gurganus ..... B21J 3/00 29/423
4,084,419 A * 4/1978 Dittrich ..... B21H 1/06 72/68
4,110,487 A * 8/1978 Rion ..... C03C 8/00 427/193
4,555,415 A * 11/1985 Mumford ..... C23D 1/00 427/193
4,843,856 A * 7/1989 Bhowal ..... B21J 3/00 72/41
5,743,121 A * 4/1998 Miller ..... B21C 23/32 72/42
9,180,511 B2 * 11/2015 Loukus ..... B22C 9/00
2012/0107547 A1 * 5/2012 Fernando ..... B32B 5/24 428/76
2012/0183708 A1 * 7/2012 Minisandram ..... B21C 23/32 428/34.6
2014/0271337 A1 * 9/2014 Banik ..... B21J 1/06 420/448
2014/0273701 A1 * 9/2014 Samanta ..... E04B 1/78 442/334
2014/0290321 A1 * 10/2014 Minisandram ..... B21C 23/32 72/46

* cited by examiner

FORMING METHOD OF FORGING OF 718 PLUS ALLOY

CROSS-REFERENCE TO RELATED APPLICATIONS

This application claims priority of Chinese Patent Application No. 201510952820.5 with a filing date of Dec. 18, 2015. The content of the aforementioned application, including any intervening amendments thereto, are incorporated herein by reference.

TECHNICAL FIELD

The invention relates to a forming method of an annular forging of high-temperature alloy, in particular to a forming method of an annular forging of 718 Plus alloy.

BACKGROUND OF THE PRESENT INVENTION

718 Plus alloy is precipitated and hardened nickel-based high-temperature alloy which has excellent high-temperature performance and good processability. Such alloy gives consideration to high-temperature performance and thermal stability of Waspaloy and the excellent processability of 718 alloy during design.

It is preferred material for high-quality rotating parts of jet engines. The alloy using temperature of the 718 Plus alloy is increased by 100° F. (55°) in comparison with the 718 alloy, and the 718 Plus alloy has higher strength, more excellent formability, better wear resistance and reduced weld cracking tendency in comparison with Waspaloy or other nickel-based high-temperature alloy with higher temperature.

Compared with the 718 alloy, the range of forging temperature of the 718 Plus alloy becomes narrower, thereby being more liable to producing weld cracks; and the final one-time forging uses the temperature of 1800° F.-1900° F. (982° C.-1038° C.) to forge according to the requirements of parts. If the low forging temperature is selected, the cracks on the surface of the material are serious, and if the temperature is high, the grain size is relatively coarse, so that the performances of the structure can not meet the using requirements.

Thus, the key for mass application of the alloy is to forge the 718 Plus alloy with good surface quality and the grain size of level 6 or above in the required range of forging temperature.

By using the existing forging forming method for treatment of the 718 Plus alloy (718 Plus), there are the following disadvantages:

The 718 Plus is liable to cracking in the forging process, and more allowance is thus required to ensure the removal of the surface cracks; and when cracking is serious, the scrappage of a product is caused;

In order to ensure the surface quality of the product, relatively high ring rolling temperature needs to be used, resulting in the situation that the grain size of the product after forming is liable to being unqualified;

When the product is forging, the requirements on forging equipment and the layout of a heating furnace are high.

SUMMARY OF PRESENT INVENTION

The inventive purpose of the application is to provide a forming method of an annular forging of 718 Plus alloy.

After the method is used to perform treatment on the annular forging of the 718 Plus alloy, the grain size of the forging of the 718 Plus achieves level 6 or above, and the surface has no common cracks.

In order to realize the inventive purpose of the application, the application adopts the following technical scheme:

A forming method of an annular forging of 718 Plus alloy of the invention is used for performing treatment on a cylindrical blank of the 718 Plus alloy, wherein:

(I) composing a first blanket (2) by ceramic fiber with the thickness of 10 mm-15 mm and high-temperature binder powder which is uniformly scattered on the ceramic fiber in the thickness of 1-2 mm, wherein the melting temperature of the high-temperature binder powder is 850-900° C., wrapping the cylindrical surface of the blank (1) of the 718 Plus alloy with the first blanket to enable the first blanket (2) scattered with the high-temperature binder powder to be in close fit with the cylindrical surface of the blank (1), further fixing the first blanket (2) with the cylindrical surface of the blank (1), then heating to 1000-1100° C., then stopping heating, immediately performing upsetting and punching treatment on the blank (1), wherein the punching diameter should not be more than ⅓ of the outer diameter of the blank (1) after upsetting, and naturally cooling the blank (1) to room temperature after the end of treatment to enable the first blanket (2) wrapped on the blank (1) to fall off naturally;

(II) composing second blankets (3) by placing the ceramic fiber with the thickness of 10 mm-15 mm on iron sheets with the thickness of 1 mm-1.5 mm and uniformly scattering the high-temperature binder powder with the thickness of 1-2 mm on the ceramic fiber, wherein the melting temperature of the high-temperature binder powder is 850-900° C., respectively wrapping the outer surface and the punched inner surface of the blank (1) after treatment in the step (I) with the second blankets to enable the second blankets (3) scattered with the high-temperature binder powder to be in close fit with the outer surface and the punched inner surface of the blank (1) respectively, respectively fixing the second blankets (3) on the outer surface and the punched inner surface of the blank (1), further heating to 1000-1060° C., then stopping heating, immediately performing blank holder reaming on the blank (1), and naturally cooling the blank (1) to room temperature after the end of treatment to enable the second blankets (3) wrapped on the blank (1) to fall off naturally;

(III) respectively wrapping the outer surface and the reamed inner surface of the blank after treatment in the step (II) with the second blankets to enable the second blankets scattered with the high-temperature binder powder to be in close fit with the outer surface and the reamed inner surface of the blank respectively, respectively fixing the second blankets on the outer surface and the reamed inner surface of the blank, further heating to 985-1038° C., then stopping heating, immediately rolling the blank to obtain a final product, and naturally cooling the blank to room temperature after the end of treatment to enable the second blankets wrapped on the blank to fall off naturally.

The forming method of the annular forging of the 718 Plus alloy of the invention, wherein, in the step (I), an iron wire with the diameter of 1-3 mm is used for fixing the first blanket and the blank together.

The forming method of the annular forging of the 718 Plus alloy of the invention, wherein, in the step (I), two iron wires with the diameter of 1-3 mm are used for fixing the first blanket and the blank together.

The forming method of the annular forging of the 718 Plus alloy of the invention, wherein, in the step (II) and the step (III), after the second blankets wrapped on the outer surface and the punched or the reamed inner surface of the blank respectively wrap the outer surface and the punched or the reamed inner surface of the blank, the second blankets are respectively fixed on the outer surface and the punched or the reamed inner surface of the blank at joints of the iron sheets on two lapped edges of the second blankets by spot welding.

The forming method of the annular forging of the 718 Plus alloy of the invention, wherein three iron sheet strips with the width of 40-60 mm are used for connecting the second blanket wrapped on the outer surface of the blank and the second blanket wrapped on the punched or the reamed inner surface of the blank together on the upper and the lower end surfaces of the blank, one end of each iron sheet strip is welded with the iron sheet on the second blanket wrapped on the outer surface of the blank together, and the other end of each iron sheet strip is welded with the iron sheet on the second blanket wrapped on the punched or the reamed inner surface of the blank.

The forming method of the annular forging of the 718 Plus alloy of the invention, wherein the high-temperature binder powder contains 10-14% of Al2O3, 45-52% of SiO2, 12-16% of CaO, 4-8% of $Na_2O$ and 15-22% of B2O3.

The forming method of the annular forging of the 718 Plus alloy of the invention, wherein the 718 Plus alloy contains 0.01-0.05% of C, not more than 0.35% of Mn, not more than 0.035% of Si, 0.004-0.020% of P, not more than 0.025% of S, 17-21% of Cr, 2.5-3.1% of Mo, 5.20-5.80% of Nb, 0.50-1.00% of Ti, 1.2-1.7% of Al, 8.00-10.00% of Co, 8.00-10.00% of Fe, 0.008-1.4% of W, 0.003-0.008% of B and the balance of Ni-containing high-temperature alloy, wherein the sum of the contents of the above ingredients is 100%.

The forming method of the annular forging of the 718 Plus alloy of the invention, wherein the heating is performed in an electric furnace.

The forming method of the annular forging of the 718 Plus alloy of the invention, wherein the ceramic fiber is the ceramic fiber containing 44% of Al2O3, 52% of SiO2, 1% of Fe2O3 and the balance of ZrO2.

Compared with the existing processing method, as for the forging of the 718 Plus alloy after the treatment by using the method of the application, the grain size of the forging achieves level 6 or above and the surface has no common cracks.

DESCRIPTION OF THE DRAWINGS

In FIG. 1 and FIG. 2, reference numeral 1: blank; reference numeral 2: first blanket; reference numeral 3: second blanket; and reference numeral 4: iron sheet strip.

DETAILED DESCRIPTION OF PREFERRED EMBODIMENTS

The chemical components of 718 Plus alloy (718 Plus) are as follows:

| | C | Mn | Si | P | S | Cr | Ni | Mo | Nb | Ti | Al | Co | Fe | W | B |
|---|---|---|---|---|---|---|---|---|---|---|---|---|---|---|---|
| % w/w, min. | 0.01 | — | — | 0.004 | — | 17.00 | BAL | 2.50 | 5.20 | 0.50 | 1.20 | 8.00 | 8.00 | 0.000 | 0.003 |
| % w/w, max. | 0.05 | 0.35 | 0.035 | 0.020 | 0.025 | 21.00 | BAL | 3.10 | 5.80 | 1.00 | 1.70 | 10.00 | 10.00 | 1.40 | 0.008 |

Figure 1:
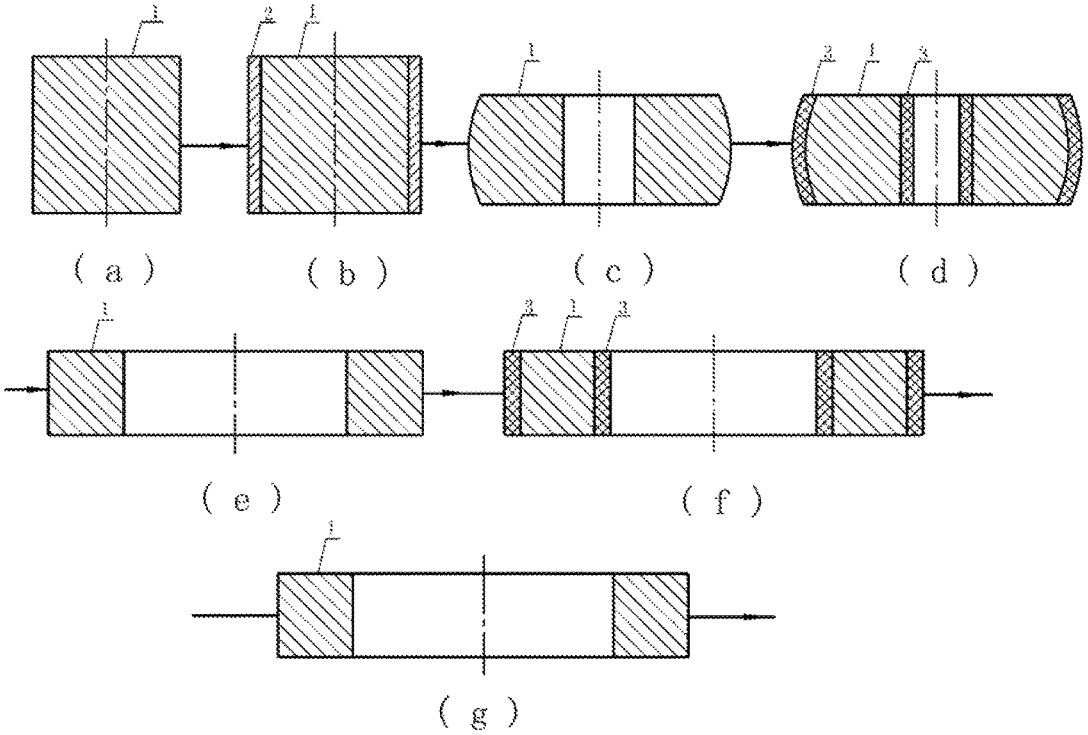
FIG. 1 is a schematic diagram of flow process of a forming method of a forging of 718 Plus alloy of the invention.
Figure 2:
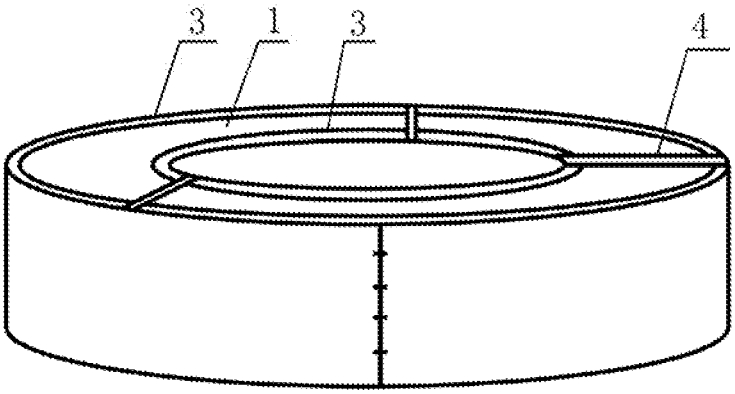
FIG. 2 is a perspective schematic diagram of a blank wrapped by iron sheets and iron sheet strips.

As shown in FIG. 1, a forming method of an annular forging of 718 Plus alloy of the invention is used for performing treatment on a cylindrical blank of the 718 Plus alloy, and the forming method comprises the following steps:

(I) composing a first blanket (2) by ceramic fiber with the thickness of 10 mm-15 mm and high-temperature binder powder which is uniformly scattered on the ceramic fiber in the thickness of 1-2 mm, wherein the melting temperature of the high-temperature binder powder is 850-900° C., wrapping the cylindrical surface of the blank (1) of the 718 Plus alloy with the first blanket to enable the first blanket (2) scattered with the high-temperature binder powder to be in close fit with the cylindrical surface of the blank (1), further fixing the first blanket (2) with the cylindrical surface of the blank (1), then heating to 1000-1100° C., then stopping heating, immediately performing upsetting and punching treatment on the blank (1), wherein the punching diameter should not be more than ⅓ of the outer diameter of the blank (1) after upsetting, and naturally cooling the blank (1) to room temperature after the end of treatment to enable the first blanket (2) wrapped on the blank (1) to fall off naturally;

(II) composing second blankets (3) by placing the ceramic fiber with the thickness of 10 mm-15 mm on iron sheets with the thickness of 1 mm-1.5 mm and uniformly scattering the high-temperature binder powder with the thickness of 1-2 mm on the ceramic fiber, wherein the melting temperature of the high-temperature binder powder is 850-900° respectively wrapping the outer surface and the punched inner surface of the blank (1) after treatment in the step (I) with the second blankets to enable the second blankets (3) scattered with the high-temperature binder powder to be in close fit with the outer surface and the punched inner surface of the blank (1) respectively, respectively fixing the second blankets (3) on the outer surface and the punched inner surface of the blank (1), further heating to 1000-1060° C., then stopping heating, immediately performing blank holder reaming on the blank (1), and naturally cooling the blank (1) to room temperature after the end of treatment to enable the second blankets (3) wrapped on the blank (1) to fall off naturally;

(III) As shown in (f)-(g) in FIG. 1, respectively wrapping the outer surface and the reamed inner surface of the blank after treatment in the step (II) with the second blankets to enable the second blankets 3 scattered with the high-temperature binder powder to be in close fit with the outer surface and the reamed inner surface of the blank 1 respectively, respectively fixing the second blankets 3 on the outer surface and the reamed inner surface of the blank 1, further heating to 985-1038° C., then stopping heating, immediately rolling the blank 1 to obtain a final product, and naturally cooling the blank 1 to room temperature after the end of treatment to enable the second blankets 3 wrapped on the blank 1 to fall off naturally.

In the step (I), an iron wire with the diameter of 1-3 mm is used for fixing the first blanket 2 and the blank 1 together; or two iron wires with the diameter of 1-3 mm are used for bundling the first blanket 2 and the blank 1 together.

In the step (II) and the step (Ill), after the second blankets 2 wrapped on the outer surface and the punched or the reamed inner surface of the blank 1 respectively wrap the outer surface and the punched or the reamed inner surface of the blank 1, the second blankets 3 are respectively fixed on the blank 1 at joints of the iron sheets on two lapped edges of the second blankets 3 by spot welding. If necessary, three iron sheet strips 4 with the width of 40-60 mm are used for connecting the second blanket 2 wrapped on the outer surface of the blank 1 and the second blanket 2 wrapped on the punched or the reamed inner surface of the blank 1 together on the upper and the lower end surfaces of the blank 1, one end of each iron sheet strip 4 is welded with the iron sheet on the second blanket 2 wrapped on the outer surface of the blank 1 together, and the other end of each iron sheet strip is welded with the iron sheet on the second blanket 2 wrapped on the punched or the reamed inner surface of the blank 1.

The high-temperature binder powder contains 10-14% of Al2O3, 45-52% of SiO2, 12-16% of CaO, 4-8% of Na2O and 15-22% of B2O3. The ceramic fiber is the ceramic fiber containing 44% of Al2O3, 52% of SiO2, 1% of Fe2O3 and the balance of ZrO2. The heating is performed in an electric furnace.

Comparison of surface cracks of the forging before and after using the invention:

| | Number of cracks (strips) | Positions of cracks | Depth of cracks (mm) |
|---|---|---|---|
| Original process | Many | Sharp corner positions | 0-3 mm |
| After using the invention | | No cracks | |

Industrial applicability: the application can be used in industry and has industrial applicability.

It should be noted that for those of skill in the art, a plurality of improvements and modifications can be made without departing from the principle of the invention, and these improvements and modifications should also be considered to be within the protection scope of the invention. The various components which are not clear in the embodiment can be implemented by using the prior art.

We claim:

1. A forming method of an annular forging of 718 Plus alloy, by performing treatment on a cylindrical blank of the 718 Plus alloy and is characterized in that:

(I) composing a first blanket (2) by a ceramic fiber with a thickness of 10 mm-15 mm and a high-temperature binder powder which is uniformly scattered on the ceramic fiber in a thickness of 1-2 mm, wherein a melting temperature of the high-temperature binder powder is 850-900° C., wrapping a cylindrical surface of a blank (1) of the 718 Plus alloy with the first blanket (2) enable the first blanket (2) scattered with the high-temperature binder powder to be in close fit with the cylindrical surface of the blank (1), further fixing the first blanket (2) with the cylindrical surface of the blank (1), then heating to 1000-1100° C., then stopping heating, immediately performing upsetting and punching treatment on the blank (1), wherein a punching diameter should not be more than ⅓ of an outer diameter of the blank (1) after upsetting, and natural cooling the blank (1) to room temperature after the treatment to enable the first blanket (2) wrapped on the blank (1) to peel off;

(II) composing second blankets (3) by placing the ceramic fiber with the thickness of 10 mm-15 mm on an iron sheets with a thickness of 1 mm-1.5 mm and uniformly scattering the high-temperature binder powder with the thickness of 1-2 mm on the ceramic fiber, wherein the melting temperature of the high-temperature binder powder is 850-900° C., respectively wrapping an outer surface and a punched inner surface of the blank (1) after treatment in the step (I) with the second blankets (3) to enable the second blankets (3) scattered with the high-temperature binder powder to be in close fit with the outer surface and the punched inner surface of the blank (1) respectively, respectively fixing the second blankets (3) on the outer surface and the punched inner surface of the blank (1), further heating to 1000-1060° C., then stopping heating, immediately performing blank holder reaming on the blank (1), and natural cooling the blank (1) to room temperature after the end of treatment to enable the second blankets (3) wrapped on the blank (1) to peel off;

(III) respectively wrapping the outer surface and a reamed inner surface of the blank after treatment in the step (II) with the second blankets (3) to enable the second blankets (3) scattered with the high-temperature binder powder to be in close fit with the outer surface and the reamed inner surface of the blank (1) respectively, respectively fixing the second blankets (3) on the outer surface and the reamed inner surface of the blank (1), further heating to 985-1038° C., then stopping heating, immediately rolling the blank (1) to obtain a final product, and natural cooling the blank (1) to room temperature after the treatment to enable the second blankets (3) wrapped on the blank (1) to peel off;

wherein in the step (II) and the step (III), after the second blankets (2) wrapped on the outer surface and the punched or the reamed inner surface of the blank (1) respectively wrap the outer surface and the punched or the reamed inner surface of the blank (1), the second blankets (3) are respectively fixed on the outer surface and the punched or the reamed inner surface of the blank (1) at joints of the iron sheet on two lapped edges of the second blankets (3) by spot welding.

2. The forming method of the annular forging of the 718 Plus alloy according to claim 1, wherein in the step (I), an iron wire with a diameter of 1-3 mm is used for fixing the first blanket (2) and the blank (1) together.

3. The forming method of the annular forging of the 718 Plus alloy according to claim 2, wherein in the step (I), two iron wires with the diameter of 1-3 mm are used for bundling the first blanket (2) and the blank (1) together.

4. The forming method of the annular forging of the 718 Plus alloy according to claim 1, wherein three iron sheet strips (4) with a width of 40-60 mm are used for connecting the second blanket (2) wrapped on the outer surface of the blank (1) and the second blanket (2) wrapped on the punched or the reamed inner surface of the blank (1) together on upper and the lower end surfaces of the blank (1), one end of each iron sheet strip (4) is welded with the iron sheet on the second blanket (2) wrapped on the outer surface of the blank (1) together, and the other end of each iron sheet strip (4) is welded with the iron sheet on the second blanket (2) wrapped on the punched or the reamed inner surface of the blank (1).

5. The forming method of the annular forging of the 718 Plus alloy according to claim 1, wherein the high-temperature binder powder contains 10-14% of $Al_2O_3$, 45-52% of $SiO_2$, 12-16% of CaO, 4-8% of $Na_2O$ and 15-22% of $B_2O_3$.

6. The forming method of the annular forging of the 718 Plus alloy according to claim 1, wherein the 718 Plus alloy contains 0.01-0.05% of C, not more than 0.35% of Mn, not more than 0.035% of Si, 0.004-0.020% of P, not more than 0.025% of S, 17-21% of Cr, 2.5-3.1% of Mo, 5.20-5.80% of Nb, 0.50-1.00% of Ti, 1.2-1.7% of Al, 8.00-10.00% of Co, 8.00-10.00% of Fe, 0.008-1.4% of W, 0.003-0.008% of B and a balance of Ni-containing high-temperature alloy, wherein a sum of the above ingredients is 100%.

7. The forming method of the annular forging of the 718 Plus alloy according to claim 1, wherein the heating is performed in an electric furnace.

8. The forming method of the annular forging of the 718 Plus alloy according to claim 1, characterized in that the ceramic fiber is the ceramic fiber containing 44% of $Al_2O_3$, 52% of $SiO_2$, 1% of $Fe_2O_3$ and a balance of $ZrO_2$.

* * * * *